United States Patent [19]

Bacchio

[11] Patent Number: 4,716,628

[45] Date of Patent: Jan. 5, 1988

[54] DEVICE FOR PRODUCING SUPERPOSED WEBS

[75] Inventor: Giovanni Bacchio, Mongrando, Italy

[73] Assignee: Fonderie Officine Riunite F.O.R. Ing. Graziano di L. Graziano & C. S.a.s., Biella, Italy

[21] Appl. No.: 937,352

[22] Filed: Dec. 3, 1986

[30] Foreign Application Priority Data

Dec. 11, 1985 [IT] Italy ..... 68039 A/85

[51] Int. Cl.[4] ..... B65H 45/103

[52] U.S. Cl. ..... 19/106 R; 19/296

[58] Field of Search ..... 19/106 R, 296, 302; 28/103

[56] References Cited

U.S. PATENT DOCUMENTS

| | | | |
|---|---|---|---|
| 3,066,358 | 12/1962 | Schiess | 19/106 R |
| 3,066,359 | 12/1962 | Kalwaites | 19/106 R |
| 3,369,276 | 2/1968 | Kalwaites | 28/103 X |
| 3,493,452 | 2/1970 | Cole | 19/296 X |
| 4,481,694 | 11/1984 | Dilo | 19/296 |
| 4,553,289 | 11/1985 | Strobl et al. | 19/296 X |

*Primary Examiner*—Louis K. Rimrodt

[57] ABSTRACT

Device for producing superposed webs of non-woven fabric on the exit side of the end comber of a carding machine, particularly for feeding a needle quilter for felting. The device comprises an adjusting unit including a series of conveyor belts movable parallel to the direction of arrival of the web, and a traversing unit fed by the adjusting unit and including a feeder belt having a first section movable parallel to the conveying direction of the adjusting unit and a second section movable at right angles to this direction for feeding a belt delivering the web with fibres arranged longitudinally. The traversing unit is capable of performing an alternating rectilinear movement in a direction parallel to the conveying direction of the adjusting unit, in synchronism with the latter, and feeds the web to an end layering belt, which belt is movable parallel to the delivery belt and has a width corresponding substantially to the distance travelled by the traversing unit.

4 Claims, 3 Drawing Figures

Figure 1:
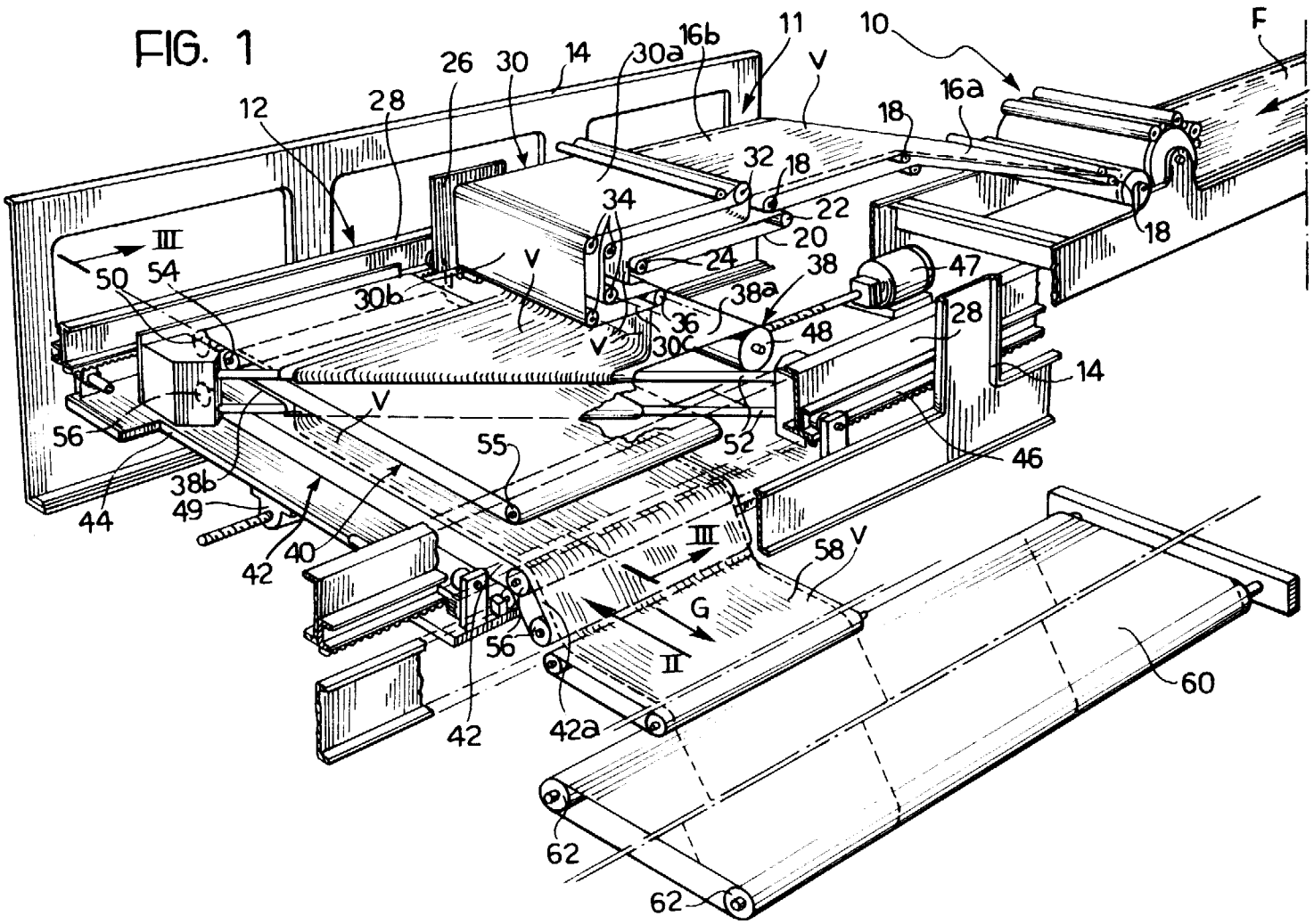

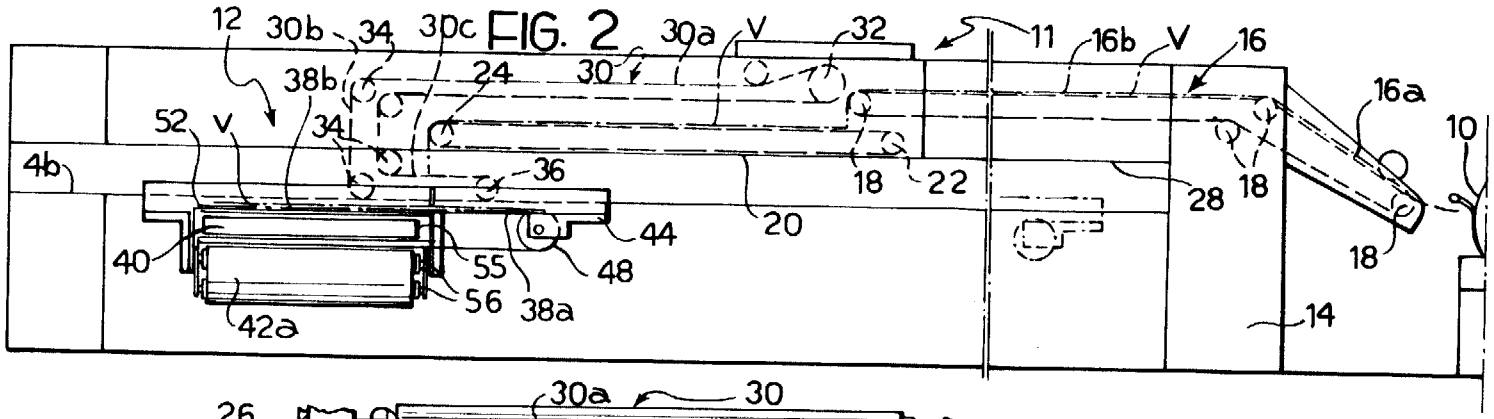
FIG. 2
FIG. 3
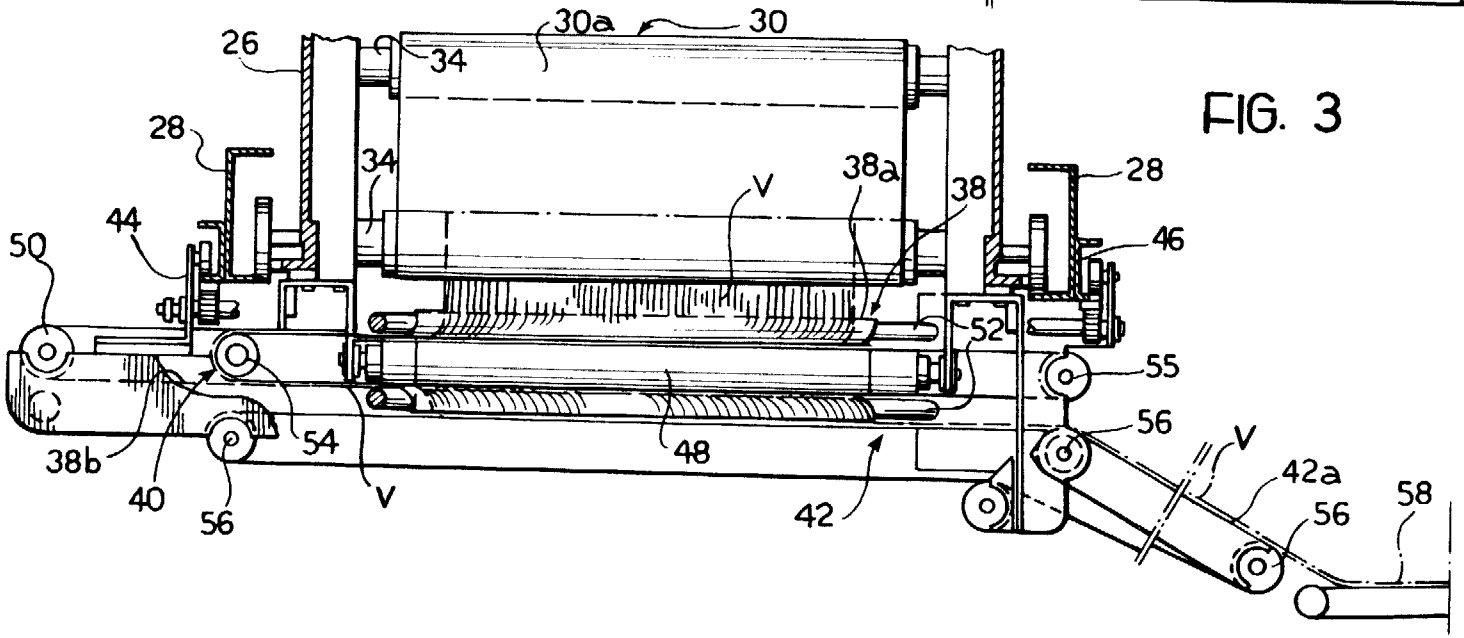

DEVICE FOR PRODUCING SUPERPOSED WEBS

The present invention relates in general to the production of superposed webs of non-woven fabric on the exit side of the end comber of a carding machine.

According to the known art, in order to obtain superposed webs of non-woven fabric downstream of a carding machine, use is made of folding devices consisting of a certain number of conveyor belts situated at different levels and capable of performing a relative movement in a manner designed to produce at the delivery end web with superposed layers which is deposited onto a receiving conveyor movable in a direction perpendicular to the direction in which the web advances when leaving the carding machine.

With this arrangement, the webs obtained on the receiving conveyor have fibres oriented transversely, that is in the direction of the width of the webs, and hence have an inadequate tensile strength in the longitudinal direction.

The object of the present invention is to overcome the above mentioned drawback and provide a device for producing superposed webs of non-woven fabric with fibres arranged longitudinally and suitable in particular for feeding a needle quilter for producing large-sized felts.

According to the invention, this object is achieved by means of a device for producing superposed webs of non-woven fabric on the exit side of the end comber of a carding machine, characterized in that it comprises an adjusting unit including a series of conveyor belts movable parallel to the direction of arrival of the web from the end comber of the carding machine, and a traversing unit fed by the adjusting unit and including a feeder belt having a first section movable parallel to the conveying direction of the said adjusting unit, a second section movable at right angles to the conveying direction of the said adjusting unit, and deviating means for deviating the said feeder belt between the said first and second sections, and a delivery belt parallel to the second section of the feeder belt; the said traversing unit being capable of performing an alternating rectilinear movement in a direction parallel to the conveying direction of the adjusting unit, in synchronism with the latter, in order to feed the web to an end layering belt, which belt is movable parallel to the said delivery belt and has a width corresponding substantially to the distance travelled by the traversing unit.

As a result of this proposed solution, the superposed webs of non-woven fabric leaving the device according to the invention have fibres arranged perpendicularly to the width of the webs and hence possess the necessary strength in the longitudinal direction.

According to the invention, the adjusting unit comprises a feeder belt fed by the end comber of the carding machine, a straight middle belt which is would around respective front and rear rollers and is fed by the feeder belt, and a substantially C-shaped delivery belt which has front, middle and rear winding rollers and is fed by the middle belt and is designed to feed the said first section of the feeder belt of the traversing unit; the said feeder, middle and delivery belts of the adjusting unit being movable at a first speed; the front and rear rollers of the middle belt and the middle rollers of the delivery belt being capable of performing an alternating rectilinear movement longitudinally in a direction parallel to the direction of displacement of the traversing unit at a second speed substantially equal to half of the said first speed, the rear roller of the delivery belt being capable of performing an alternating rectilinear movement in the same direction in accordance with the said first speed, and the speed of displacement of the traversing unit being substantially equal to the said first speed.

Preferably the said deviating means associated with the feeder belt of the traversing unit comprise bar-type transfer members forming an angle of 45° relative to the said first and second sections of the feeder belt, and a middle conveyor belt is located between the said second section and the delivery belt.

Further characteristic features of the invention will become apparent during the course of the detailed description which follows, with reference to the attached drawings provided purely by way of a non-limiting example, in which:

FIG. 1 is a partial, diagrammatic, perspective view, partly in section, of a device according to the invention, FIG. 2 is a diagrammatic front elevation view on a larger scale in accordance with the arrow II shown in FIG. 1, and, FIG. 3 is a sectional view on a larger scale in accordance with the line III—III shown in FIG. 1.

Referring initially to FIG. 1, 10 denotes the end combing unit of a cylinder carding machine for producing a web of non-woven fabrics with fibres with oriented in the same direction, namely in the longitudinal direction. The combing unit 10 and also the components of the carding machine situated upstream of this unit are generally known per se and, therefore, for the sake of brevity, will not be described in detail.

An adjusting unit, indicated generally by 11, and a traversing unit, indicated generally by 12, are arranged on the exit side of the end combing unit 10. The adjusting unit 11 and the traversing unit 12 are arranged in succession and at different levels (the former at a higher level and the latter as a lower level) and are supported in the manner explained below by two vertical side walls 14 which extend parallel to the direction in which the web V advances when leaving the carding machine. This direction is indicated by the arrow F in FIG. 1.

Referring in more detail to FIG. 2, the adjusting unit 11 comprises a continuous band feeder conveyor or belt 16 which is wound around motor-driven rollers 18 and the upper and conveying section of which comprises a first portion 16*a* which extends with a rising slope from the end comber 10, and a second portion 16*b* which extends horizontally. The belt 16 is moved forward at a predetermined constant speed and feeds a middle belt 20, the upper conveying section of which extends below the delivery end of the feeder belt 16. The belt 20 is wound around two motor-driven rollers 22, 24 mounted on a carriage structure 26 movable along horizontal guide rails 28 mounted on the two side walls 14.

30 denotes a generaly C-shaped delivery belt with a horizontal section 30*a* arranged above the middle belt 20, a vertical section 30*b* situated in front of the roller 24 of this middle belt 20, and a lower horizontal section 30*c* arranged below the delivery end of this middle belt 20 and therefore having a conveying direction opposite to that of the latter.

The delivery belt 30 is wound around motor-driven rollers indicated by 32, 34 and 36, respectively. In particular, the roller 32 is supported in the stationary position by the walls 14, whereas the rollers 34 are mounted on the carriage 26 and the roller 36 is mounted on a carriage structure 44 movable along horizontal guide rails 46 mounted on the side walls 14, parallel to the guide rails 28.

The methods used to actuate the rollers driving the belts 16, 20 and 30 are conventional in the sector of continuous belt conveyor installations and, in order to simplify illustration, have not been indicated in the drawings. In order to achieve actuation. chain drive mechanism or the equivalent, which are controlled by means of an electric motor, may be conveniently used.

The carriage 26 carrying the rollers 22, 24 and 34 can be displaced along the guide rails 28 so as to perform an alternating rectilinear movement, using methods which can also be implemented by a person skilled in the art, for example by means of an electric motor with an inverter and a drive mechanism with chains or gears (not shown).

However, it is important to point out that the speed of displacement of the carriage 26 when performing its alternating movement is substantially equal to half the speed at which the feeder belt 16 advances, whereas the conveying speeds of the belts 20 and 30 correspond to the speed at which the said belt 16 advances.

The traversing unit 12, illustrated in greater detail in FIG. 3, comprises essentially a continuous band feeder conveyor or belt 38, a middle conveyor belt 40 and a delivery belt 42 mounted on a carriage structure 44 capable of performing an alternating rectilinear movement along the guide rails 46. Displacement of the carriage 44 is controlled by means of an electric motor 47 and a screw and nut gearing 49 in synchronism with displacement of the carriage 26. It should be noted that the speed of displacement of the carriage 44, and therefore of the entire traversing unit 12 and the roller 36 of the delivery belt 30 of the adjusting unit, is equal to the speed at which the feeder belt 16 of the adjusting unit 11 advances and is hence, in practice, double compared to the speed of displacement of the carriage 26.

The feeder belt 38 of the traversing unit 12 has a first section **38*a*, situated below the delivery end of the belt 30 of the adjusting unit 11 and movable parallel to the conveying direction of the belts 16, 20 and 30 of this unit, and a second section 38*b* which extends at right angles to the section 38*a*, namely transversely to the conveying direction of the belts 16, 20 and 30**.

In fact, the belt 38 is wound around a first roller 48 parallel to the rollers 18, 22, 24, 32, 34 and 36 and around a second roller 50 perpendicular to the roller 48. Between the rollers 48 and 50 that are two fixed transverse bars 52 forming an angle of 45° in relation to the axes of the rollers 48 and 50 and around which the belt 38 is passed at the end of the section **38*a*, or at the start of the section 38*b***.

The middle belt 40 extends parallel to the section **38*b* of the feeder belt 38 inside the latter and is wound around two rollers 54 and 55 parallel to the roller 50. In practice, the upper and lower portions of the middle belt 40 extending between the transfer bars 52 and the roller 54 cooperate with the corresponding portions of the section 38*b* of the belt 38** forming an interspace for containing and conveying the web V, in the manner explained below.

The delivery belt 42 extends below the middle belt 40, parallel to the latter, and has an end discharge section **42*a* projecting downwards outside the carriage structure 44. The belt 42 is wound around rollers 56 parallel to the rollers 50, 54 and 55 and feeds a conveyor mat 58 displaceable together with the carriage 44 so as to feed a layering end sleeve or belt 60. The said sleeve or belt is wound around motor-driven rollers 62 parallel to the rollers 56 and has a width corresponding substantially to the distance traversed by the unit 12**.

Motorized operation of the various rollers 48, 50, 54, 55 and 56 is also achieved using methods which are not illustrated for the sake of simplicity but which can be implemented by a person skilled in the art, for example by means of an electric motor and chain or gear drives.

During operation, the web V of non-woven fabric leaving the end comber 10 is taken up by the feeder roller 16 and initially follows the path indicated in FIG. 2. In fact, the web V is deposited from the delivery end of the belt 16 onto the middle belt 20 which moves in the manner described above and, from the delivery end of this middle belt 20, drops onto the section **30*c* of the delivery belt 30** which also moves in the manner explained above.

The web V is then deposited from the delivery end of the section **30*c* onto the section 38*a* of the belt 38 movable with the carriage 44** in the manner described above.

The web V is then deviated with the belt 38 by the upper bar 52, in the manner clearly visible in FIG. 1, and moves between the section **38*b* and the belt 42 until it reaches the delivery belt 42, in the region of the lower bar 52. At this point, the web V leaves the traversing unit 12, moving in the direction indicated by the arrow G in FIG. 1, namely perpendicularly to the direction of advance F, reaching the conveyor 58**.

In this manner, at the delivery end of the unit 12, a continuous web is obtained which has fibres oriented longitudinally, that is perpendicularly to the width of the web, and which is finally wound in superposed layers onto the end layering belt 60.

Obviously the forward and return travel of the carriage 44, and hence of the traversing unit 12, can be varied in distance in accordance with the width of the layering belt 60.

Obviously the constructional details and embodiments can be greatly varied with respect to that which has been described and illustrated, without thereby going outside the scope of the present invention.

I claim:

1. Device for producing superposed webs of non-woven fabric on the exit of an end comber of a carding machine from which a web is discharged along a direction of arrival, comprising an adjusting unit including a series of conveyor belts movable parallel to the direction of arrival of the web from the end comber 10 of the carding machine, and a traversing unit feed by the adjusting unit and including a feeder belt having a first section movable parallel to the conveying direction of the said adjusting unit, a second section movable at right angles to the conveying direction of the said adjusting unit, and deviating means for deviating the said feeder belt between the said first and second sections, a delivery belt parallel to the second section of the feeder belt, and a layering end belt movable parallel to the said delivery belt; the said traversing unit being capable of performing an alternating rectilinear movement in a direction of displacement parallel to the conveying direction of the adjusting unit, in synchronism with the latter, in order to feed the web to the said layering end belt, which belt has a width corresponding substantially to the distance traversed by the said traversing unit.

2. Device according to claim 1, wherein the adjusting unit comprises a feeder belt fed by the end comber of the carding machine a straight middle belt having respective front and rear rollers, the said middle belt being wound around said front and rear rollers and being fed by the feeder belt, and a substantially C-shaped delivery belt which has front, middle and rear winding rollers and is fed by the middle belt and is designed to feed the said first section of the feeder belt of the traversing unit; the said feeder, middle and delivery belts of the adjusting unit being movable at a first speed; the front and rear rollers of the middle belt and the middle rollers of the delivery belt being capable of performing together an alternating rectilinear movement in a direction parallel to the direction of displacement of the traversing unit at a second speed substantially equal to half of the said first speed, the rear roller of the delivery belt being capable of performing an alternating rectilinear movement in the same direction in accordance with the said first speed, and the speed of displacement of the traversing unit being substantially equal to the said first speed.

3. Device according to claim 1 or claim 2, comprising guides parallel to the direction of arrival of the web from the above mentioned end comber of the carding machine and a pair of carriages movable along said guides, wherein the winding rollers of the middle belt together with the midle rollers of the delivery belt of the adjusting unit and the rear rollers of the said delivery belt together with the above mentioned traversing unit are mounted on one and respectively the other of the said two carriages.

4. Device according to claim 1 or claim 2, wherein the above mentioned deviating means of the traversing unit comprise bar-type transfer members formed an angle of 45° relative to the said first and second sections of the feeder belt of the traversing unit and in that a middle conveying belt is located between the said second section and the delivery belt.

* * * * *

UNITED STATES PATENT AND TRADEMARK OFFICE

CERTIFICATE OF CORRECTION

PATENT NO. : 4,716,628

DATED : January 5, 1988

INVENTOR(S) : Giovanni Bacchio

It is certified that error appears in the above-identified patent and that said Letters Patent are hereby corrected as shown below:

Col. 1 Line 12, after "end" insert -- a --

Col. 1 Line 57, change "would" to -- wound --

Col. 2 Line 27, after "fibres" delete -- with --

Col. 2 Line 46, after "upper" delete -- and --

Col. 2 Line 55, change "generaly" to -- generally --

Col. 3 Line 48, change "that" to -- there --

Col. 3 Lines 48 and 49, change "transverse" to -- transfer

Col. 4 Line 50, change "feed" to -- fed --

Col. 4 Line 68, after "machine" insert -- , --

Col. 6 Line 8, change "midle" to -- middle --

Col. 6 Line 9, change "rollers" to -- roller --

UNITED STATES PATENT AND TRADEMARK OFFICE

CERTIFICATE OF CORRECTION

PATENT NO. : 4,716,628

DATED : January 5, 1988

INVENTOR(S) : Giovanni Bacchio

It is certified that error appears in the above-identified patent and that said Letters Patent is hereby corrected as shown below:

Col 6, line 15, changed "formed" to -- forming --.

Signed and Sealed this

Seventh Day of June, 1988

*Attest:*

*Attesting Officer*

DONALD J. QUIGG

*Commissioner of Patents and Trademarks*